US006293378B1

(12) United States Patent
Lin

(10) Patent No.: US 6,293,378 B1
(45) Date of Patent: Sep. 25, 2001

(54) FRAME BRACKET FOR LIGHTWEIGHT LUGGAGE

(75) Inventor: Jer Hong Lin, Taipei (CN)

(73) Assignee: Chaw Khong Technology Co., Ltd., Taipei County (TW)

( * ) Notice: Subject to any disclaimer, the term of this patent is extended or adjusted under 35 U.S.C. 154(b) by 0 days.

(21) Appl. No.: 09/532,743

(22) Filed: Mar. 22, 2000

(30) Foreign Application Priority Data

Oct. 13, 1999 (TW) ..... 88217365

(51) Int. Cl.[7] ..... A45C 5/12; A45C 5/00

(52) U.S. Cl. ..... 190/24; 190/18 R; 190/18 A; 190/115; 190/127; 190/124; 190/37

(58) Field of Search ..... 190/18 R, 18 A, 190/115, 124, 127, 37, 24

(56) References Cited

U.S. PATENT DOCUMENTS 5,295,565 * 3/1994 Latshaw ..... 190/18 A
5,482,147 * 1/1996 Wang ..... 190/115
5,529,156 * 6/1996 Yang ..... 190/122
5,588,512 * 12/1996 Lin ..... 190/115
5,653,319 * 8/1997 Wang ..... 190/115
6,062,356 * 5/2000 Nykoluk ..... 190/18 R
6,119,835 * 9/2000 Lin ..... 190/127
6,148,973 * 11/2000 Chang ..... 190/127

* cited by examiner

*Primary Examiner*—Allan N. Shoap
*Assistant Examiner*—Tri M. Mai
(74) *Attorney, Agent, or Firm*—Dougherty & Troxell

(57) ABSTRACT

A frame bracket for lightweight luggage comprises a U-shaped plastic frame, a fabric frame covered on the U-shaped plastic frame, two L-shaped lower skeletal frame members each having a vertical member provided at the front corners of the bottom to secure the support plate, the plastic frame, and the fabric frame, and a U-shaped support plate provided on the bottom of U-shaped plastic frame. With the enhancement of U-shaped support plate and L-shaped lower skeletal frame members, the purpose of protecting the bottom of luggage and strengthening the structural frame is achieved.

3 Claims, 5 Drawing Sheets

FRAME BRACKET FOR LIGHTWEIGHT LUGGAGE

BACKGROUND OF THE INVENTION

1. Field of the Invention

The present invention relates to luggage and more particularly to a frame bracket for lightweight luggage.

2. Description of Related Art

Conventionally, support plate and frame are made of lightweight material or even omitted by luggage manufacturer in order to decrease the weight of luggage for ease of transporting and lifting as well as for easing the burden on traveler. It is also understood that frame is the indispensable supporting structure for luggage. Only employ a lightweight frame or make improvements thereon is a possible way. FIG. 1 shows a prior art wheeled luggage comprising a U-shaped plastic frame F, a fabric frame P (shown in phantom lines) covered on plastic frame F, a bezel B on the top of plastic frame F, a support M on the bottom of plastic frame F, a handle assembly H fixedly secured to the bezel B and support M respectively, and wheel mounts W at two opposing corners on the bottom of plastic frame F. Further, a lower skeletal frame member S is extended horizontally from either wheel mount W having a member S2 on the rear portion of lower skeletal frame member S for inserting into the slot W1 of wheel mount W, a screw S3 for threadly securing lower skeletal frame member S to plastic frame F, and a feet S1 extended downwardly from the front the front portion of lower skeletal frame member S a suitable distance such that luggage may stand in an upright position when not in use.

However, luggage is usually heavy when fully loaded. Thus the bottom frame F1 may recess and comes into contact with the ground in an even worse condition. In the worst condition, the wheel mounts W may deform. Thus, there is a need for wheeled luggage that is lightweight and has a sufficient structural strength.

SUMMARY OF THE INVENTION

It is an object of the present invention to provide a frame bracket for lightweight luggage for eliminating all prior art drawbacks.

It is another object of the present invention to provide a frame bracket for lightweight luggage that is lightweight, has simple structure, is easy to manufacture, and is cost effective.

It is still another object of the present invention to provide a frame bracket for lightweight luggage in which bottom frame member is enhanced by an additional support plate such that bottom frame member is not susceptible to deformation which in turn prolongs the life cycle of wheel mount form improving the durability of luggage.

To achieve the above and other objects, one aspect of the present invention provides a frame bracket for lightweight luggage comprising a U-shaped plastic frame, a fabric frame covered on the U-shaped plastic frame, two L-shaped lower skeletal frame members provided at the front corners of the bottom, and a U-shaped support plate provided on the bottom of U-shaped plastic frame. With the enhancement of U-shaped support plate and L-shaped lower skeletal frame members, the purpose of protecting the bottom of luggage and strengthening the structural frame is achieved.

Another aspect of the present invention a frame bracket for lightweight luggage comprising a U-shaped plastic frame, a fabric frame covered on the U-shaped plastic frame, two L-shaped lower skeletal frame members provided at the front corners of the bottom, a U-shaped support plate provided on the bottom of U-shaped plastic frame, and two second support plates each provided on a side near the bottom of U-shaped plastic frame. With the enhancement of U-shaped support plate, second support plates, and L-shaped lower skeletal frame members, the purpose of protecting the bottom of luggage and strengthening the structural frame is achieved.

The above and other objects, features and advantages of the present invention will become apparent from the following detailed description taken with the accompanying drawings.

DETAILED DESCRIPTION OF THE PREFERRED EMBODIMENTS

Figure 1:
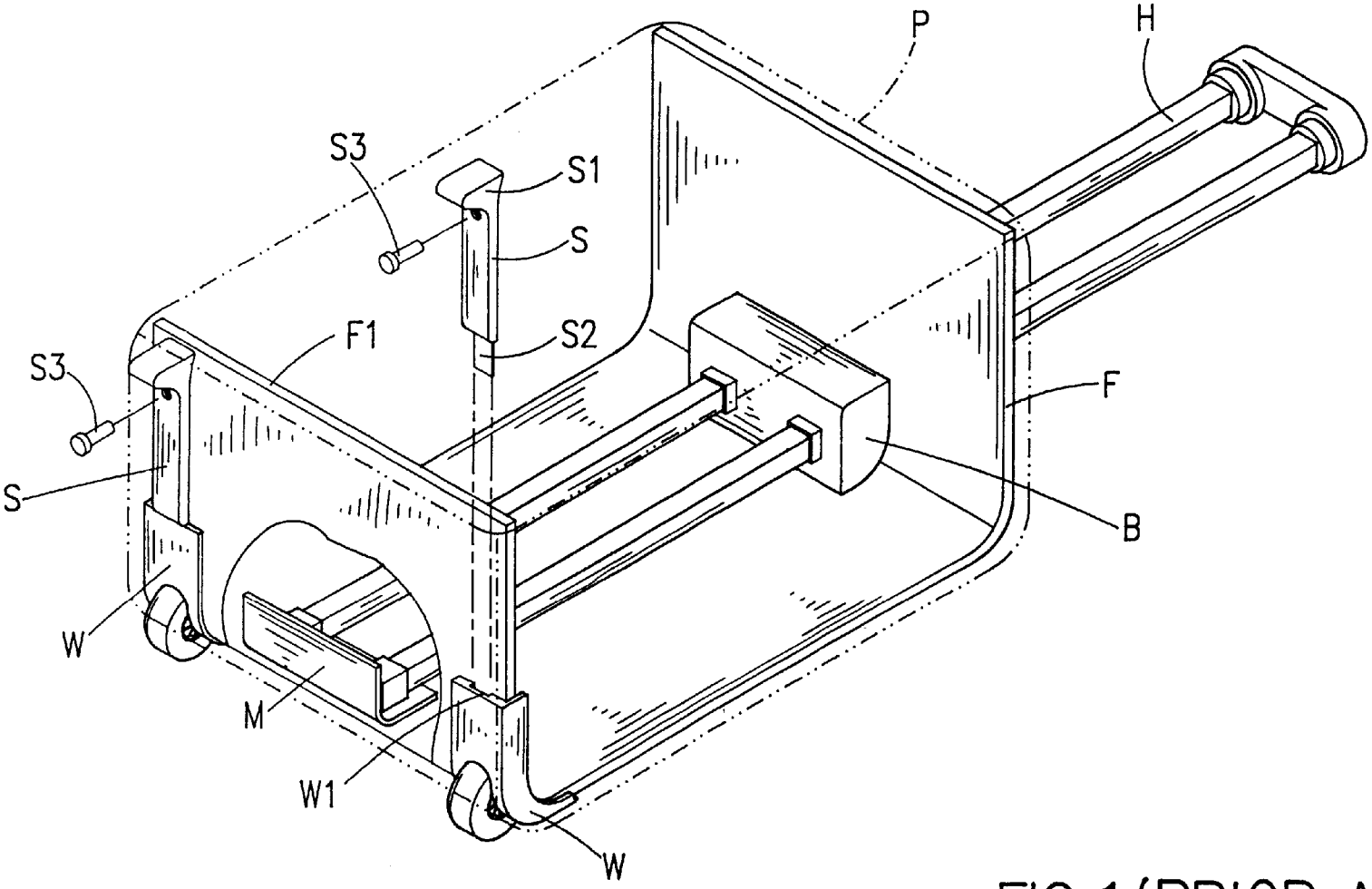
FIG. 1 (PRIOR ART)
FIG. 1 is a schematic view of a prior art lightweight luggage.
Figure 2:
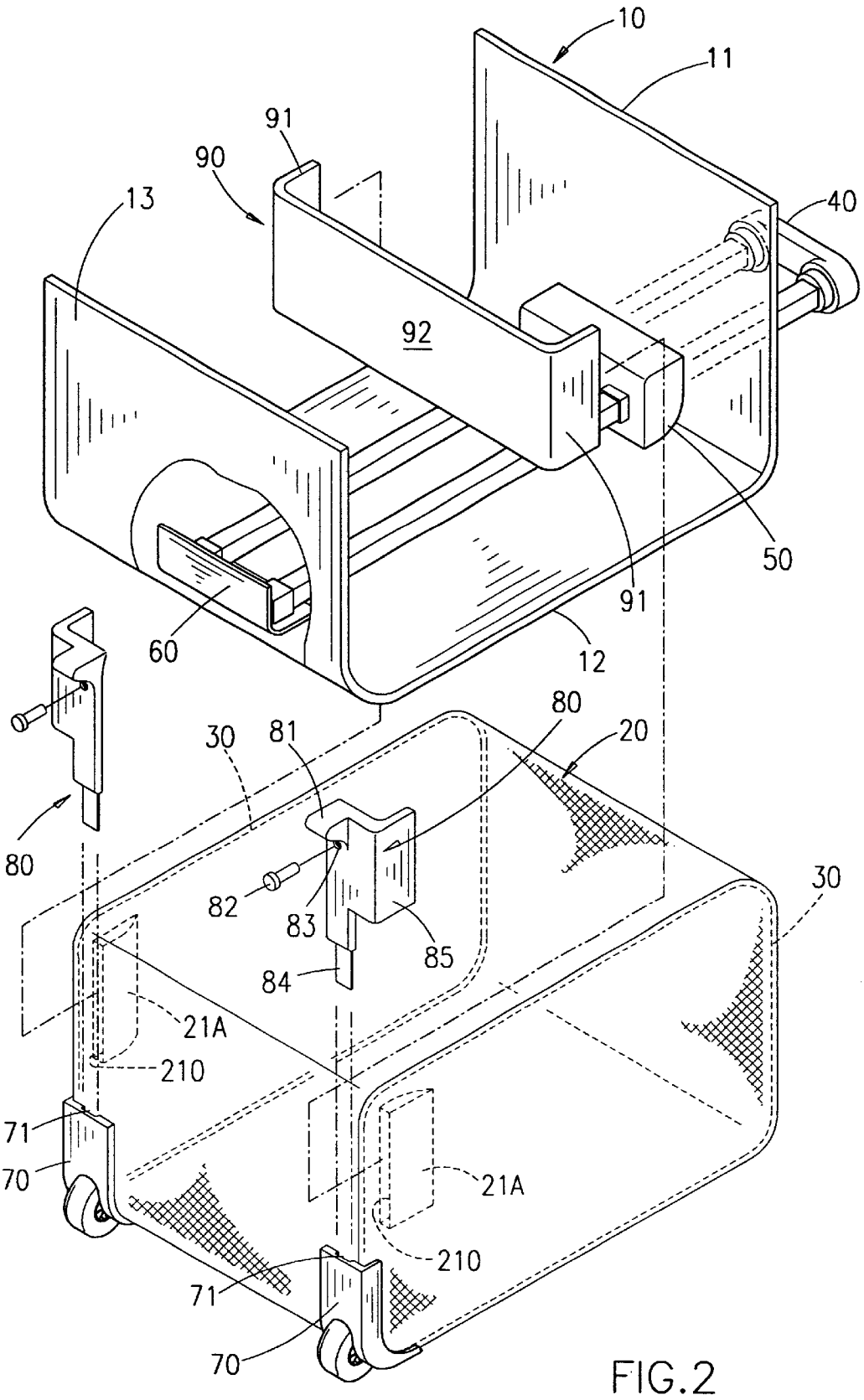
FIG. 2 is a schematic view of a first embodiment of lightweight luggage according to the invention.

Referring to FIG. 2, there is shown a lightweight luggage constructed in accordance with the invention comprising a U-shaped plastic frame 10, a frabic frame 20 covered on the U-shaped plastic frame 10, two side steel frame members 30, a handle assembly 40, a bezel 50, two wheel mounts 70, two L-shaped lower skeletal frame members 80 provided at the front corners of the bottom, and a U-shaped support plate 90 provided on the bottom of U-shaped plastic frame 10 wherein U-shaped frame 10 has a top member 11, a rear member 12 and a bottom member 13, bezel 50 is provided on the top of rear member 12, support 60 is provided on the top of bottom member 13 such that handle assembly 40 can fixedly secure to the bezel 50 and support 60 respectively, the provision of two side steel frame members 30 may enhance the structural strength of fabric frame 20 for preventing wrinkle, two pockets 21A are provided on either side of fabric frame 20 with the opening 210 toward the ground in an upright position, and U-shaped support plate 90 is made of perforated hardboard or plywood. It is designed that the sides of luggage are supported by steel frame members 30 and U-shaped frame 10 is enhanced by the internal U-shaped support plate 90. As such, the structural strength of luggage is significantly enhanced.

In assembly, the sides 91 of U-shaped support plate 90 each inserts into the corresponding pocket 21A through the opening 210. Then insert each member 84 on the rear portion of L-shaped lower skeletal frame member 80 into the slot 71 of wheel mount 70. Then thread screw 82 through the hole 83 on the bottom of the feet 81 of L-shaped lower skeletal frame 80 to secure L-shaped lower skeletal frame member 80 to the U-shaped frame 10. As such, the vertical member 85 tightly presses on the side 91 of U-shaped support plate 90, steel frame member 30, and fabric frame 20 on the front corner. With this and the provision of internal U-shaped support plate 90 as stated above, the purpose of protecting the bottom of luggage and strengthening the structural frame is achieved.

Figure 3:
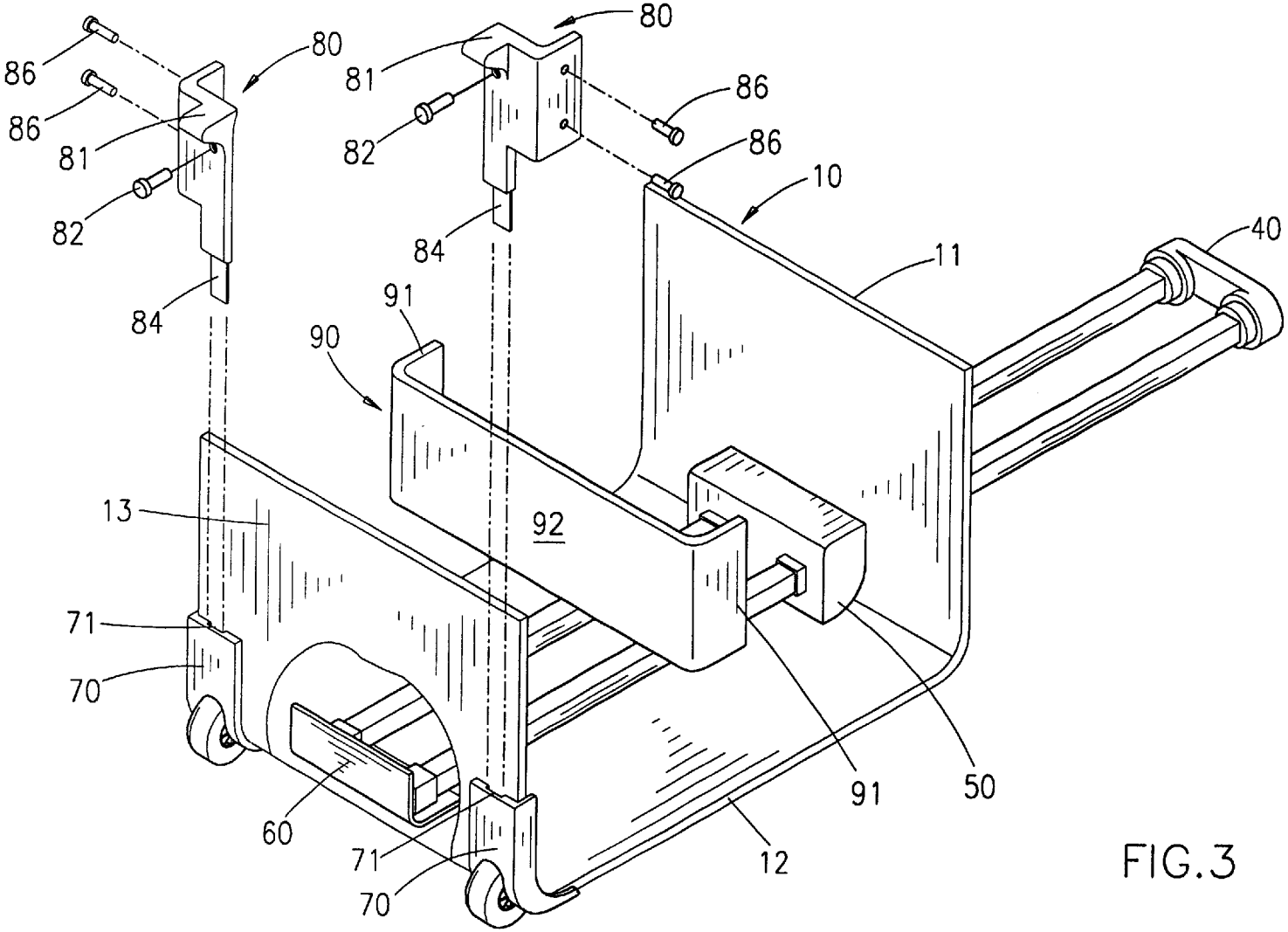
FIG. 3 is a schematic view of a second embodiment of a lightweight luggage according to the invention.
Figure 4:
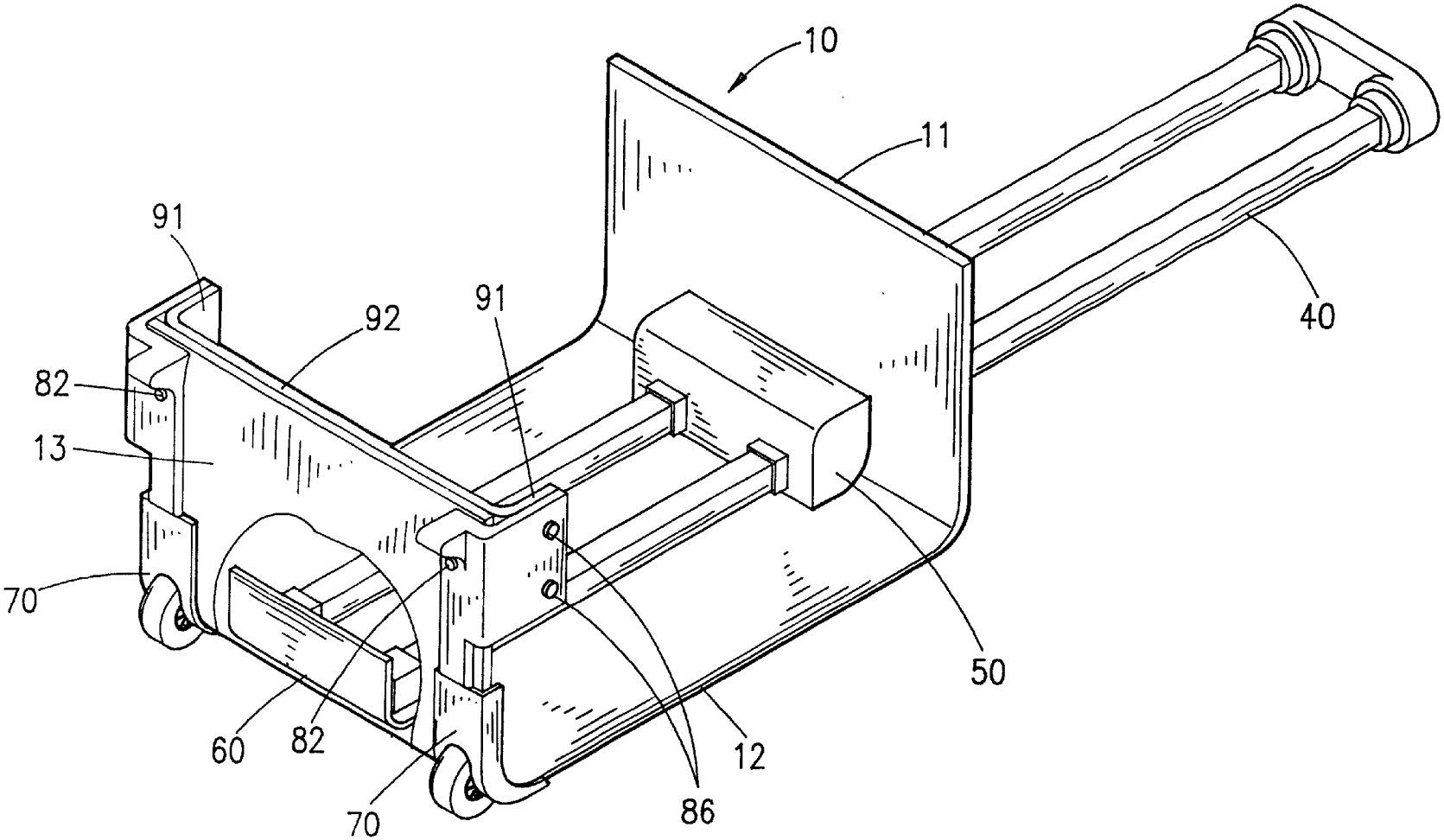
FIG. 4 is a perspective view of FIG. 3, with a portion of bottom frame member and fabric frame broken away to certain details of the invention.

Referring to FIGS. 3–4, there is shown a second embodiment of the invention. This embodiment is generally configured the same as the first embodiment with only a few differences as described below. The pockets 21A of the first embodiment are omitted by the replacement of two side screws 86 and bottom screw a 82. As such, thread screws 86 and 82 through fabric frame (not shown) and U-shaped frame 10 to secure two sides 91 of U-shaped support plate 90 to the luggage frame (FIG. 4). This achieves the same effect as the first embodiment.

Figure 5:
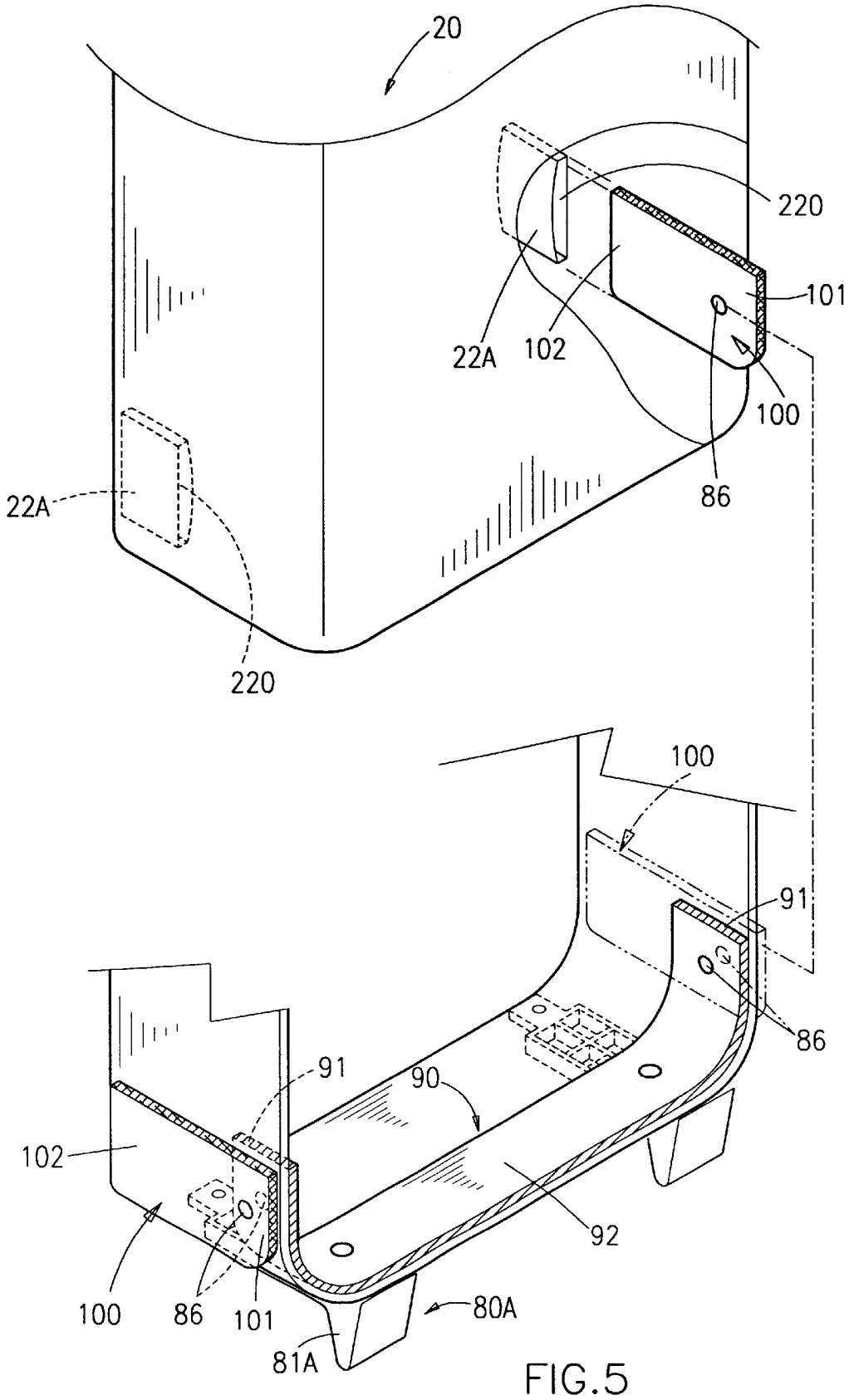
FIG. 5 is an exploded view of a third embodiment of a lightweight luggage according to the invention.

Referring to FIG. 5, there is shown a third embodiment of the invention. One aspect of this embodiment is the provision of two second support plates 100 each on a side near the bottom of U-shaped plastic frame 10 being partially superposed on the side 91 of U-shaped support plate 90 wherein one end 101 of second support plate 100 is secured to fabric frame 20, U-shaped frame 10, and U-shaped support plate 90 by threads 86, while the other end 102 of second support plate 100 is inserted into pocket 22A through opening 220. Note that lower skeletal frame member 80A (without having a L-shaped member) is secured to frame in a known manner. This also achieves the same effect as the first embodiment.

While the invention herein disclosed has been described by means of specific embodiments, numerous modifications and variations could be made thereto by those skilled in the art without departing from the scope of the invention set forth in the claims.

What is claimed is:

1. A frame bracket for lightweight luggage comprising:

a U-shaped plastic frame having two sides;

a fabric frame covered on the U-shaped plastic frame having a pocket on each side;

two L-shaped lower skeletal frame members each having a vertical member provided at a front corner of a bottom of the luggage; and a U-shaped support plate provided on a bottom of the U-shaped plastic frame, the U-shaped support plate having two sides, wherein each of the two sides of the U-shaped support plate are inserted into the corresponding pocket of the fabric frame and the structural strength of the luggage is enhanced by the U-shaped support plate and the L-shaped lower skeletal frame members.

2. The frame bracket of claim 1, wherein each of the vertical members of the L-shaped lower skeletal frame members is secured to one of the two sides of the U-shaped support plate, the U-shaped plastic frame, and the fabric frame on the front corner of the luggage.

3. A frame bracket for a lightweight luggage comprising:

a U-shaped plastic frame having two frame sides and a bottom;

a fabric frame covered on the U-shaped plastic frame, the fabric frame having a pocket on opposite sides;

a U-shaped support plate provided on the bottom of the U-shaped plastic frame, the U-shaped support plate having two support plate sides; and two second support plates each having one end inserted into one of the pockets so as to be located adjacent to the bottom of the U-shaped plastic frame and each being secured to one of the two support plate sides, whereby the structural strength of the luggage is enhanced by the U-shaped support plate and the second support plates.

* * * * *